US006524706B1

(12) United States Patent
Manning et al.

(10) Patent No.: US 6,524,706 B1
(45) Date of Patent: Feb. 25, 2003

(54) REDUCTION OF ENERGETIC FILLER SENSITIVITY IN PROPELLANTS THROUGH COATING

(75) Inventors: Thelma G. Manning, Montville, NJ (US); Bernard Strauss, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 37 days.

(21) Appl. No.: 09/820,373

(22) Filed: Mar. 27, 2001

(51) Int. Cl.[7] ..... B32B 5/16; C06B 45/18

(52) U.S. Cl. ..... 428/403; 102/290; 149/3; 149/9

(58) Field of Search ..... 428/403; 102/290; 149/9, 3, 110

(56) References Cited

U.S. PATENT DOCUMENTS 3,730,094 A * 5/1973 Quinlan ..... 102/38
4,072,546 A * 2/1978 Winer ..... 149/19.8
5,487,851 A * 1/1996 Dillehay et al. ..... 264/3.3
5,690,868 A * 11/1997 Strauss et al. ..... 264/3.1
5,866,842 A * 2/1999 Wilson et al. ..... 149/19.6

* cited by examiner

*Primary Examiner*—H. Thi Le
(74) *Attorney, Agent, or Firm*—Robert Charles Beam; John F. Moran

(57) ABSTRACT

A main energetic ingredient filler useful for propellant-based munitions, comprising filler particles having a fine particle size of less than about 10 micrometers diameter and a thin coating of graphite on the filler particles in an amount such that the weight of the graphite is less than about two percent of the weight of the filler particles. Preferred filler particles have a fine particle size of less than about ten micrometers diameter, and most preferred are fillers with a particle size having an average particle diameter ranging from about two to about eight micrometers. The preferred filler is selected from the group consisting of CL-20, TNAZ, NQ, RDX, HMX and mixtures thereof. Most preferred is a filler of CL-20 ground to an average particle diameter of about five to ten micrometers. The preferred amount of graphite comprises about one percent by weight of the filler particles. The filler may be formed into a propellant including a binder and a plasticizer. The method of making the main energetic ingredient filler of this invention includes the steps of grinding the filler to a fine particle size and coating graphite on the particles in an amount such that the weight of graphite is less than about two percent of the weight of the filler particles.

14 Claims, No Drawings

REDUCTION OF ENERGETIC FILLER SENSITIVITY IN PROPELLANTS THROUGH COATING

The invention described herein may be manufactured, used, and licensed by or for the U.S. Government for U.S. Governmental purposes.

FIELD OF THE INVENTION

The present invention relates generally to a process for manufacturing an explosive propellant. More particularly the invention relates to a coating step in the process for manufacturing explosive propellants using a less energetic material as a coating agent.

BACKGROUND OF THE INVENTION

To improve the survivability of current gun propellant-based munitions, insensitivity to external factors must be taken into account when designing ordnance. By reducing the vulnerability of propellants to indirect detonation or ignition during battle, production, stockpiling, and transportation, better protection will be afforded to personnel and equipment.

The range of threats to gun propellant varies with the different systems in which it is placed. These threats include shaped-charge jets, kinetic energy penetrators, and hot spall. Therefore, materials must be able to withstand a large degree of impact, shock wave energy, and/or heat depending on the threat or threats. Moreover, friction and electrostatic discharge vulnerability should be low to ensure safe handling and manufacture. Testing, as documented in MIL-STD-2105-A is performed to determine material vulnerability.

The sensitivity requirements of the propellant depend upon the particular battlefield threat to the ordnance into which the propellant will be incorporated. The most common threats are contact with excessive heat, impact, and shock. Particular concern in any new approach to propellants should be addressed.

Propellants are mixtures containing different highly reactive materials; these materials, give the propellant desirable gas-generating properties. However, the sensitivity of the propellant will primarily depend upon the individual sensitivity of its respective ingredients. Designers of propellants find themselves having to balance the need for stability with the need for proper burning rates and energy. Since ballistic performance is a priority in selecting the appropriate propellant, the use of inert materials is very limited, particularly in propellants possessing resistance to accidental ignition, known as LOVA (low vulnerability ammunition) type compositions. Any potential trade-off between sensitivity and performance has led engineers to seek new energetic materials that satisfy certain sensitivity as well as energetic requirements.

Two approaches to enhance insensitivity of propellants have been to reduce the particle size of the filler material and to coat the filler material. Studies have shown that coated fine explosive particles and especially coated fine explosive materials in a composite propellant cause a less violent explosion reaction. This can be attributed to two factors. First, more surface area of the filler is exposed to the binder/plasticizer matrix by using fine particles. Second, hot spots and shear band friction formed in the micro structure of propellant grains with sufficiently small particles may exhibit reduced friction to the point where the temperatures are inadequate for ignition.

Accordingly, one object of the present invention is to provide a gun propellant-based munitions with improved survivability.

Another object of this invention is to reduce the vulnerability of propellants to indirect detonation or ignition during battle, production, stockpiling, and transportation.

Still another object of this invention is to resolve the potential trade-off between sensitivity and performance to satisfy certain sensitivity as well as energetic requirements.

Yet another object of this invention is provide a method in which it would be possible to employ fine explosive particles in a composite propellant.

Other objects will appear hereinafter.

SUMMARY OF THE INVENTION

It has now been discovered that the above and other objects of the present invention may be accomplished in the following manner. Specifically, an improved main energetic ingredient filler has now been discovered that has substantially improved survivability when subjected to external factors.

The filler is extremely useful for propellant-based munitions. The filler comprises filler particles having a fine particle size of less than about 10 micrometers diameter and a thin coating of graphite on the filler particles in an amount such that the weight of the graphite is less than about two percent of the weight of the filler particles.

The filler of this invention may be formed into a propellant including a binder and a plasticizer. The method of making the filler of this invention includes the steps of grinding the filler to a fine particle size and coating graphite on the particles in an amount such that the weight of graphite is less than about two percent of the weight of the filler particles. The filler is then used as normal in the formulation of the propellant or other end use for which the filler is intended to be used.

The preferred fillers ale Hexanitrohexaazaisowurtzitane or CL-20, and 1,3,3-Trinitroazetidine on TNAZ. Also preferred are mixtures thereof. Currently used fillers such as RDX (Cyclotrimethylene Trinitramine), NQ (nitroguanidine) and HMX (Cyclotetramethylene Tetranitramine) are also suitable for the present invention. Most preferred is a filler of CL-20 ground to an average particle diameter of about five to ten micrometers.

Preferred filler particles have a fine particle size of less than about ten micrometers diameter, and most preferred are fillers with a particle size having an average particle diameter ranging from about two to about eight micrometers.

The preferred amount of graphite comprises about one percent by weight of the filler particles. When the amount of graphite is less than about 0.1% of the filler weight, the benefits are not as clearly demonstrable by some of the tests. If the graphite exceeds about 5%, based on the weight of the filler, energetic performance suffers. It is necessary to select the proper amount of graphite to balance the trade-off between sensitivity and performance to satisfy both certain sensitivity as well as energetic requirements.

DETAILED DESCRIPTION OF THE PREFERRED EMBODIMENT

The present invention has many advantages over the prior art propellant formulations. The filler describe and claimed herein is highly suitable to reduce the vulnerability of propellants to indirect detonation or ignition during battle, production, stockpiling, and transportation.

The present invention comprises the formation of fine particle filler, which serves in many devices as the main energetic ingredient of many munitions compositions, coated with a small amount of graphite to produce a free flowing powder with excellent particle distribution capabilities.

In order to demonstrate the effectiveness of the present invention, the sensitivity of three different groups of materials were characterized. These three groups comprise (1) energetic fillers, (2) highly-filled propellant formulations with slightly energetic binders, and (3) moderately-filled propellant formulations with energetic binders. To accomplish the experiments set forth below, a coating of about one percent by weight of graphite, based on the weight of the filler, was used, although other amounts are effective, again depending on the balance needed between sensitivity and energy. The coating was applied to the filler in a dilute mixture of graphite in a volatile solvent that was then removed by evaporation.

Since particle size is a major variable with respect to sensitivity, all coated samples and the non-coated standard material were derived from the same lot of finely ground filler. Since the coatings are thin, particle size of the coated and the standard filler is essentially similar. The particle size similarities were confirmed by MICROTRAC measurements.

In order to test the invention's response to various external stimuli, several tests were performed, as described below.

Impact Sensitivity

The impact sensitivity test was conducted to compare the relative impact initiation of the two sets of fillers. The apparatus consisted of a 2.5 kilogram steel drop weight with a 30 milligram sample resting on sandpaper between two steel anvils. This is a NOL Type 12 Impact Tester. The drop height corresponding to the 50% probability of initiation was used as an indication of impact sensitivity. The 50% initiation point was determined via the Bruceton Up-and-Down method. Initiation was defined as any evidence of burning or detonation that occurred during impact. Twenty such runs were performed in order to generate a value.

Small Scale Card Gap

In this test a standard donor explosive and the sample were pressed at the same pressure, in a hollow, thick-walled brass cylinder with a cellulose acetate barrier (card) in between. The donor explosive produces a shock pressure of uniform magnitude which is attenuated by the card, and the attenuated shock is transmitted to the sample. The card thickness corresponding to the 50% probability of detonation is determined with a modified Bruceton Up-and-Down Method. Twelve such runs were performed in order to generate a value. The thicker the barrier in which detonation occurs, the more sensitive the sample is to shock.

Ignition Delay

Ignition delay is actually a measure of the time between the sample burning or detonating and the initiation of the ignition source. This measure was actually obtained from another analysis—the heat of explosion. A hot wire was used to ignite the material. A Nicolet Digital Oscilloscope Model #2090-III was used for the delay time data acquisition. Two runs were performed in order to generate a value. The longer the ignition delay is, the less sensitive the material is to thermal stimuli.

Hot Fragment Conductive Ignition Test

This test measures the relative vulnerability to ignition by a hot steel fragment that is dropped upon the material suddenly. In order to simulate differently sized fragments, namely hot spall, five steel balls of different weights, specifically 0.25 g., 0.43 g., 1.03 g., 2.03 g., and 3.5 g, were used. The temperature of the balls was increased by fifty degrees Celsius increments and dropped on the samples until complete decomposition of the sample occurred. Two such runs were performed in order to generate a value. Higher temperatures indicate a greater thermal resiliency. This test was only performed on the moderately filled propellant.

Vacuum Thermal Stability

In this test, a five gram sample is placed in a 90° C. vacuum chamber for forty hours and the amount of gas evolved is measured. Three such runs were performed in order to generate a value. This is another standard propellant test that was utilized to compare thermal stability in which one run was performed in order to generate a value. A greater amount of gas evolution normally shows a smaller resiliency to thermal stimulus.

Sympathetic Detonation Test

The sympathetic detonation test measures the resistance of four cartridges loaded with propellant to detonation via shock by another cartridge that has been detonated by a shaped charge jet. The four acceptor cartridges were placed as situated in the ammunition round, around the detonated (donor) cartridge. Aluminum witness plates are placed equidistant from the acceptor cartridges. The acceptor cartridge is then detonated by the shaped charge jet, and the depth of the resulting dents in the witness plates are measured. One run is performed in order to generate a value. Larger dents in the witness plate indicates a greater sensitivity to shock.

Presented below in Table I are the results of these tests comparing a standard filler with one in accordance with the invention. The particle sizes for the different fillers did not vary significantly. As noted in Table I, the graphite coated filler of the present invention had reduced impact sensitivity of about 40%; however the endothermic effects reduced the energy by about 3%. Other sensitivity tests had positive results as well. Ignition delay increased from 64 to 903 milliseconds and other tests show improvement.

TABLE I

TESTING ON THE FILLER

| SAMPLE Graphite | Standard | With |
|---|---|---|
| Avg. Part. Diam., μm | 6–7 | 6–7 |
| Impact, cm | 22.3 ± 3.6 | 31.4 ± 3.0 |
| Ignition delay, msec | 64 ± 5.0 | 903 ± 75 |
| Heat of Expl., cal/g. | 1347 ± 0.5 | 1306 ± 1.0 |
| Small Scale Card Gap | | |
| Pressed Density, g/cc | 1.56 | 1.58 |
| Card thickness, Ins. | 0.345 | 0.295 |

For the propellant compositions, the only significant effect the coating has on the sensitivity can be seen in Table II, from the impact sensitivity results of the highly filled system. The average drop weight height increased from 54.2 cm for the standard filler propellant to 116.5 cm for the invention propellant. This result is comparable to the impact insensitivity improvement noted in Table I. However, the 3.4% decrease in ignition delay with the graphite filler of Table II conflicts with the result in Table I. Thus the ignition delay results are not considered to be totally accurate.

TABLE II

TESTING ON THE HIGHLY-FILLED PROPELLANT

| SAMPLE Graphite | Standard | With |
|---|---|---|
| energetic filler, % | 76 | 76 |
| energetic binder, % | 4 | 4 |
| inert binder, % | 12 | 12 |
| energetic plasticizer, % | 7.6 | 7.6 |
| stabilizer, % | 0.4 | 0.4 |
| Impact sensitivity, cm | 54.2 ± 1.8 | 116.5 ± 1.9 |
| Ignition Delay, msec | 145 ± 4.0 | 139 ± 1.0 |

The 16% decrease in the witness plate dents of the first two acceptors from the sympathetic detonation test in Table III indicates a lower shock sensitivity of the moderately filled propellant containing a graphite coated filler. The vacuum stability results in Table III indicate that the coated filler and the standard filler propellants had similar compatibilities and thermal sensitivities. The HFCIT data shows that the samples have similar ignition threshold temperatures.

TABLE III

TESTING ON MODERATELY FILLED PROPELLANT

| SAMPLE Graphite | Standard | With |
|---|---|---|
| energetic filler, % | 34 | 34 |
| energetic binder, % | 40 | 40 |
| energetic plasticizer, % | 25 | 25 |
| stabilizer, % | 1.0 | 1.0 |
| Ignition Delay, msec | 126 ± 1.0 | 163 ± 1.0 |
| Vacuum stability, msec. | 0.81 | 0.95 |
| HFCIT, ° C. | | |
| 0.25 g ball | 538 | 438 |
| 0.43 g ball | 463 | 413 |
| 1.03 g ball | 388 | 413 |
| 2.03 g ball | 363 | 363 |
| 3.50 g ball | 338 | 363 |
| Ave. Acceptor Witness Plate Dent, ins | | |
| Acc. #1 | 0.048 | 0.032 |
| Acc. #2 | 0.032 | 0.022 |
| Acc. #3 | 0.010 | 0.008 |
| Acc. #4 | 0.006 | 0.006 |

The foregoing experimental results indicate that, for some propellant threats, coating with graphite lowers the sensitivity. These threats, shock and impact, are very serious threats to most weapon systems, and the reduction of the threat that these external stimuli pose to the propellant is an important improvement to the system. The energy reduction with coating the filler as indicated by the heat of explosion tests was small as compared to the diminished impact and shock sensitivity tests. Thus the trade-off between slightly reduced energy and insensitivity favors the use of the coated fillers of this invention.

While particular embodiments of the present invention have been illustrated and described herein, it is not intended that these illustrations and descriptions limit the invention. Changes and modifications may be made herein without departing from the scope and spirit of the following claims.

What is claimed is:

1. A main energetic ingredient filler useful for propellant-based munitions, comprising:

filler particles having a fine particle size of less than about ten micrometers diameter; and a thin coating of graphite on said filler particles in an amount such that the weight of said graphite is less than about two percent of the weight of said filler particles.

2. The filler of claim 1, wherein said filler particle size has an average particle diameter ranging from about two to about eight micrometers.

3. The filler of claim 1, wherein said graphite comprises about one percent by weight of said filler particles.

4. The filler of claim 1, wherein filler is selected from the group consisting of CL-20, TNAZ, NQ, RDX, HMX and mixtures thereof.

5. The filler of claim 1, wherein said filler is CL-20 ground to an average particle diameter of about five to ten micrometers.

6. The filler of claim 1, formed into a propellant including a binder and a plasticizer.

7. A main energetic ingredient filler useful for propellant-based munitions, comprising:

filler particles having a fine particle size of about six to seven micrometers diameter, said filler being selected from the group consisting of CL-20, TNAZ, NQ, RDX, HMX and mixtures thereof; and a thin coating of graphite on said filler particles in an amount such that the weight of said graphite is about one percent of the weight of said filler particles.

8. The filler of claim 7, wherein said filler is CL-20, said filler being formed into a propellant including a binder and a plasticizer.

9. A method of making a main energetic ingredient filler useful for propellant-based munitions, comprising the steps of:

grinding filler particles to a fine particle size of less than about ten micrometers diameter; and coating graphite on said filler particles in an amount such that the weight of said graphite is less than about two percent of the weight of said filler particles.

10. The method of claim 9, wherein said filler particle size has an average particle diameter ranging from about two to about eight micrometers.

11. The method of claim 9, wherein said graphite comprises about one percent by weight of said filler particles.

12. The method of claim 9, wherein filler is selected from the group consisting of CL-20, TNAZ, NQ, RDX, HMX and mixtures thereof.

13. The method of claim 9, wherein said filler is CL-20 which is ground to an average particle diameter of about five to ten micrometers.

14. The method of claim 9 comprising the additional step of forming said filler into a propellant including a binder and a plasticizer.

* * * * *